US011668153B2

(12) United States Patent
Vargo, Jr. et al.

(10) Patent No.: US 11,668,153 B2
(45) Date of Patent: Jun. 6, 2023

(54) CEMENT HEAD AND FIBER SHEATH FOR TOP PLUG FIBER DEPLOYMENT

(71) Applicant: HALLIBURTON ENERGY SERVICES, INC., Houston, TX (US)

(72) Inventors: Richard Frank Vargo, Jr., Katy, TX (US); Gregory Scott Gustke, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/090,518

(22) Filed: Nov. 5, 2020

(65) Prior Publication Data

US 2021/0238946 A1 Aug. 5, 2021

Related U.S. Application Data

(60) Provisional application No. 62/968,928, filed on Jan. 31, 2020, provisional application No. 62/968,962, filed on Jan. 31, 2020.

(51) Int. Cl.

| | |
|---|---|
| ***E21B 33/05*** | (2006.01) |
| ***E21B 47/07*** | (2012.01) |
| ***E21B 47/135*** | (2012.01) |

(52) U.S. Cl.

CPC ..... *E21B 33/05* (2013.01); *E21B 47/07* (2020.05); *E21B 47/135* (2020.05)

(58) Field of Classification Search

CPC ..... E21B 33/05; E21B 47/135; E21B 47/07

See application file for complete search history.

(56) References Cited

U.S. PATENT DOCUMENTS

| | | | | |
|---|---|---|---|---|
| 2002/0157828 | A1* | 10/2002 | King | E21B 47/01 166/250.14 |
| 2004/0060697 | A1* | 4/2004 | Tilton | E21B 47/01 166/250.14 |
| 2008/0272931 | A1* | 11/2008 | Auzerais | E21B 33/16 356/477 |
| 2009/0219171 | A1 | 9/2009 | Vigneaux | |
| 2011/0079401 | A1* | 4/2011 | Gambier | E21B 33/16 166/117.6 |
| 2014/0034301 | A1 | 2/2014 | Leblanc | |
| 2016/0160632 | A1 | 6/2016 | Mericas et al. | |
| 2018/0245424 | A1 | 8/2018 | Stokley et al. | |
| 2018/0313206 | A1* | 11/2018 | Dirksen | E21B 33/16 |

FOREIGN PATENT DOCUMENTS

WO 2019132860 A1 4/2019

OTHER PUBLICATIONS

International Search Report and Written Opinion, PCT Application No. PCT/US2020/059460, dated Feb. 26, 2021.

* cited by examiner

*Primary Examiner* — Abby J Flynn
*Assistant Examiner* — Yanick A Akaragwe
(74) *Attorney, Agent, or Firm* — Novak Druce Carroll LLP

(57) ABSTRACT

Methods and systems for modifying a plug container to permit a fiber pass-through allowing data to be communicated from a pressurized environment into a non-pressurized environment. The systems and methods including surrounding a communication line with a protective sheath coupled with a top plug and a cap of a plug container including an elongated body having a flow path therethrough. The cap including a pass-through for receiving the communication line and obtaining data corresponding to one or more wellbore conditions including at least a temperature, a pressure, and a top plug location.

15 Claims, 7 Drawing Sheets

CEMENT HEAD AND FIBER SHEATH FOR TOP PLUG FIBER DEPLOYMENT

CROSS-REFERENCE TO RELATED APPLICATIONS

This application claims priority to U.S. Provisional Patent Application 62/968,928, which was filed in the U.S. Patent and Trademark Office on Jan. 31, 2020, and U.S. Provisional Patent Application 62/968,962, which was filed in the U.S. Patent and Trademark Office on Jan. 31, 2020, which are incorporated herein by reference in their entirely for all purposes.

TECHNICAL FIELD

The present disclosure generally relates to a system and method for modifying a plug container to permit a fiber pass-through to allow data to be communicated from a pressurized environment into a non-pressurized environment. The present disclosure further relates to a system and method for deploying a fiber surrounded by a fiber sheath during pumping operations.

BACKGROUND

In the oil and gas industry, it can be required to measure characteristics and/or compositions of substances located at remote subterranean locations and convey the result to the earth's surface for processing and analysis. For instance, it may be required to measure chemical and/or physical properties of substances located in subterranean hydrocarbon-bearing formations and convey the results of the measurement over long distances to the earth's surface. The measurements may be carried out using electrical devices; however, there is a limited amount of electrical power available to operate such devices and transmit the measurements over long distances to the surface using electrical signals with a high signal-to-noise ratio (SNR).

During completion of the wellbore, the annular space between the wellbore wall and a casing string (or casing) can be filled with cement. The process is referred to as "cementing" the wellbore. A lower plug can be inserted into the casing string after which cement can be pumped into the casing string. An upper plug can be inserted into the wellbore after a desired amount of cement has been injected. The upper plug, the cement, and the lower plug can be forced downhole by injecting displacement fluid into the casing string. Variations in the pressure of the displacement fluid can be used to determine the location of the upper plug, the cement, and the lower plug. These variations in pressure can be small and may not always be detected or may be incorrectly interpreted. Accurate information relating to the position of the upper plug, and thereby the cement below it, can prevent damage to the well or other errors in the cementing process. For example, variations in the pressure of the displacement fluid can occur when the lower plug gets trapped at an undesired location in the casing string, this can be incorrectly interpreted to mean the lower plug has reached its destination at a float collar at the bottom of the casing string.

BRIEF DESCRIPTION OF THE DRAWINGS

In order to describe the manner in which the advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
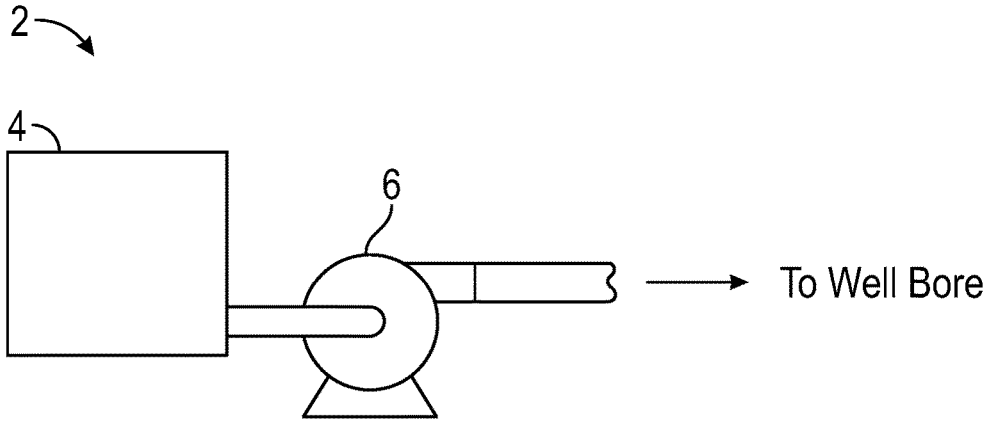
FIG. 1 illustrates a system for preparation and delivery of a cement composition to a wellbore in accordance with aspects of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Knowing the location of the upper cement plug can increase the integrity of the well cementing process. As such, there is a need in the art to be able to deploy a top plug having a fiber coupled therewith into an oil and gas well that can be released under pressure, such as during pumping operations. A fiber deployed in this manner must also be able to continuously transmit data from within the wellbore to surface equipment. A major problem in deploying a fiber during pumping operations is that pressure differentials across the plug container (such as a cement head) need to be maintained. For example, the fiber connection at the surface is at atmospheric pressure conditions, whereas the fiber connection on the downhole side of the plug container is subject to wellbore conditions (such as increased pressures and temperatures). No plug container currently exists which is capable of releasing a fiber or facilitate communications via a top plug during pumping operations. The modification to a plug container described herein provides a means to allow for continuous data communication between surface and downhole, including an adequate seal such that no pressure bleeds through the fiber connection device.

The present disclosure further relates to systems and methods for modifying a plug container to allow for a pass through by means of a bladder or pack-off to allow a fiber to transfer data from a pressurized condition to atmospheric conditions. For example, the unique modification of an existing plug container allows the fiber to pass through the cap of the plug container to allow deployment of the fiber during high-pressure pumping operations within the wellbore. In at least one example the pass through can include a threaded attachment. In the alternative, the pass through can include an opening to allow for a push-through coupling.

In addition, the proposed methodology as further described herein to convey a fiber via a top plug may require the top plug to be longer in length than a conventional top plug. Therefore, a secondary modification to the plug container can be made to accommodate a longer top plug which may contain a fiber spool therein. Modifications disclosed herein can extend to include drill-pipe heads as well as casing heads to allow use in liner, sub-sea and casing applications.

Furthermore, to obtain viable information from downhole the fiber must be protected from fluid displacement within the casing that may stress the fiber in an axial direction. Stress caused by fluid movement about the fiber can damage the fiber, causing the fiber to fail. As such, the present disclosure further relates to methods and systems for providing a sheath that can be placed over a bare fiber to reduce the forces placed on the fiber within the wellbore. In at least one instance, the sheathing can be affixed to the plug container such that the stress imparted from fluid movement is applied to the sheath rather than the fiber. As such, the fiber is not subjected to any stress from the displacement of the plug during the deployment of the fiber.

The modified plug container and fiber sheath described above can be used in a wellbore during a pumping operation. FIG. 1 illustrates a system 2 that may be used in the preparation of a cement composition in accordance with present disclosure. Specifically, FIG. 1 illustrates a system 2 for the preparation of a cement composition and delivery of the composition to a wellbore in accordance with one or more embodiments. As shown, the cement composition may be mixed in mixing equipment 4, such as a jet mixer, re-circulating mixer, or a batch mixer. The cement composition can then be pumped via pumping equipment 6 to the wellbore. In some instances, the mixing equipment 4 and the pumping equipment 6 may be disposed on one or more cement trucks as will be apparent to those of ordinary skill in the art. In some instances, a jet mixer may be used, for example, to continuously mix the composition, including water, as it is being pumped into the wellbore.

Figure 2A:
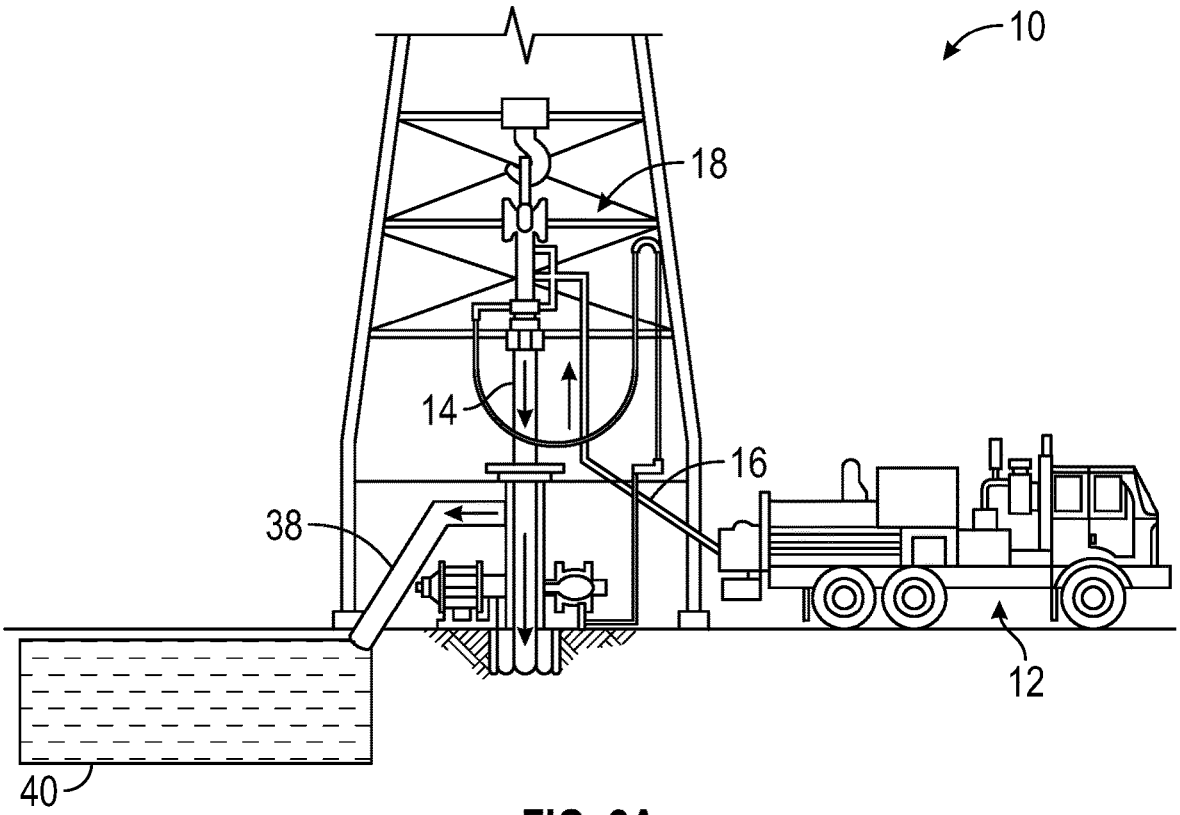
FIG. 2A illustrates surface equipment that may be used in placement of a cement composition in a wellbore in accordance with aspects of the present disclosure.

An example technique and system for placing a cement composition into a wellbore drilled through a subterranean earth formation will now be described with reference to FIGS. 2A and 2B. Specifically, FIG. 2A illustrates surface equipment 10 that may be used in the placement of a cement composition in accordance with certain aspects of the present disclosure. As illustrated, the surface equipment 10 may include a cementing unit 12, which may include one or more cement trucks. The cementing unit 12 may include mixing equipment 4 and pumping equipment 6 (e.g., FIG. 1) as will be apparent to those of ordinary skill in the art. The cementing unit 12 may pump a cement composition 14 through a feed pipe 16 and to a plug container 18 which conveys the cement composition 14 downhole. In at least on instance, the plug container 18 can be modified as described in further detail below to allow for a fiber to be pumped into the well coupled with a top plug. The ability to track the location of a top plug as it is pumped into a well, and capture temperature and pressure information from the fiber coupled therewith, is highly dependent upon the integrity of the fiber itself.

Modifications, additions, or omissions may be made to FIG. 2A without departing from the spirit and scope of the present disclosure. For example, FIG. 2A depicts components of the operational well system 10 in a particular configuration. However, any suitable configuration of components may be used. Furthermore, fewer components or additional components beyond those illustrated may be included in the operational well system 10 without departing from the spirit and scope of the present disclosure. It should also be noted that while FIG. 2A generally depicts a land-based operation, those skilled in the art would readily recognize that the principles described herein are equally applicable to operations that employ floating or sea-based platforms and rigs, without departing from the scope and spirit of the disclosure.

Figure 2B:
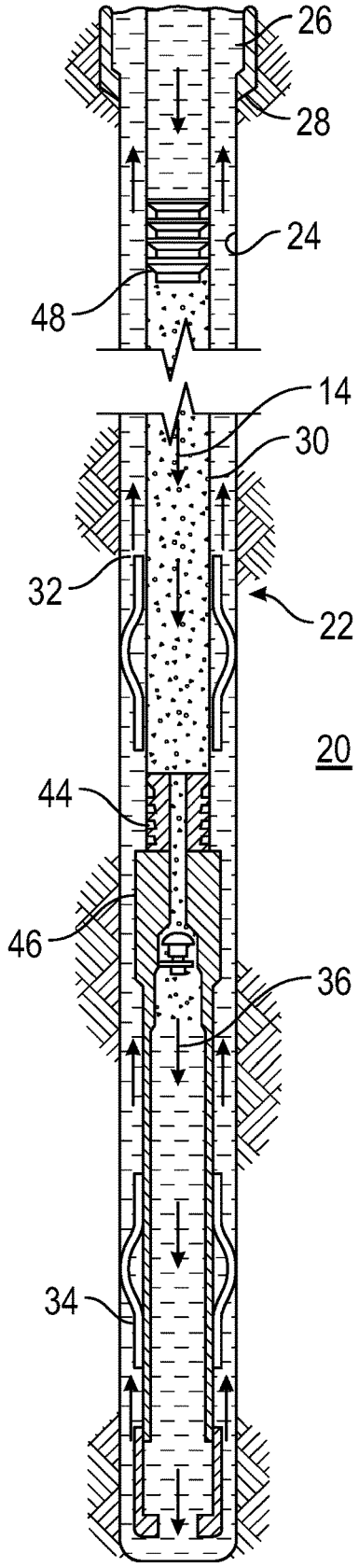
FIG. 2B illustrates placement of a cement composition into a wellbore annulus in accordance with aspects of the present disclosure.

Turning now to FIG. 2B, the cementing composition 14 may be placed into a subterranean earth formation 20 in accordance with example aspects. As illustrated, a wellbore 22 may be drilled into the subterranean earth formation 20. The wellbore 22 comprises walls 24 and can have a surface casing 26 inserted into the wellbore 22. The surface casing 26 may be cemented to the walls 24 of the wellbore 22 by cement sheath 28. In the illustrated instance, one or more additional conduits (e.g., intermediate casing, production casing, liners, etc.) shown here as casing 30 may also be disposed in the wellbore 22. As illustrated, a wellbore annulus 32 is formed between the casing 30 and the walls 24 of the wellbore 22 and/or the surface casing 26. One or more centralizers 34 may be attached to the casing 30, for example, to centralize the casing 30 in the wellbore 22 prior to and during the cementing operation.

With continued reference to FIG. 2B, the cement composition 14 may be pumped down the interior of the casing 30. In at least one instance, the cement composition 14 can include one or more binders. The binders used may directly or indirectly affect one or more components or pieces of equipment associated with the preparations, delivery, recapture, recycling, reuse, and/or disposal of the disclosed binder compositions. For example, the disclosed binder compositions may directly or indirectly affect one or more mixers, related mixing equipment, mud pits, storage facilities or units, composition separators, heat exchangers, sensors, gauges, pumps, compressors, and the like used generate, store, monitor, regulate, and/or recondition the exemplary binder compositions. The disclosed binder compositions may also directly or indirectly affect any transport or delivery equipment used to convey the binder compositions to a well site or downhole such as, for example, any transport vessels, conduits, pipelines, trucks, tubulars, and/or pipes used to compositionally move the binder compositions from one location to another, any pumps, compressors, or motors (e.g., topside or downhole) used to drive the binder compositions into motion, any valves or related joints used to regulate the pressure or flow rate of the binder compositions, and any sensors (i.e., pressure and temperature), gauges, and/or combinations thereof, and the like. The disclosed binder compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devise, autonomous inflow control devices, outflow control devices, etc.), couplings (e.g., electro-hydraulic wet connect, dry connect, inductive coupler, etc.), sensors (e.g., optical fibers), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like Referring back to FIG. 2A, the cement composition 14 may be allowed to flow down the interior of the casing 30 into the wellbore annulus 32. The cement composition 14 may be allowed to set in the wellbore annulus 32, for example, to form a cement sheath that supports and positions the casing 30 in the wellbore 22. While not illustrated, other techniques may also be utilized for introduction of the cement composition 14.

As it is introduced, the cement composition 14 may displace other fluids 36, such as drilling fluids and/or spacer fluids, which may be present in the interior of the casing 30 and/or the wellbore annulus 32. At least a portion of the displaced fluids 36 may exit the wellbore annulus 32 via a flow line 38 and be deposited, for example, in one or more retention pits 40 (e.g., a mud pit), as shown in FIG. 2A. Referring again to FIG. 2B, a bottom plug 44 may be introduced into the wellbore 22 ahead of the cement composition 14, for example, to separate the cement composition 14 from the fluids 36 that may be inside the casing 30 prior to cementing. After the bottom plug 44 reaches the landing collar 46, a diaphragm or other suitable device ruptures to allow the cement composition 14 through the bottom plug 44. In FIG. 2B, the bottom plug 44 is shown on the landing collar 46. In the illustrated instance, a top plug 48 may be introduced into the wellbore 22 behind the cement composition 14. The top plug 48 may separate the cement composition 14 from a displacement fluid 50 and also push the cement composition 14 through the bottom plug 44. As stated above, real-time information regarding plug placement can improve the cementing process.

Modifications, additions, or omissions may be made to FIG. 2B without departing from the spirit and scope of the present disclosure. It should also be noted that while FIG. 2B generally depicts a vertical well section, those skilled in the art would readily recognize that the principles described herein are equally applicable to operations in inclined well sections, direction well sections, horizontal well sections, and the like without departing from the scope of the present disclosure.

Figure 3A:
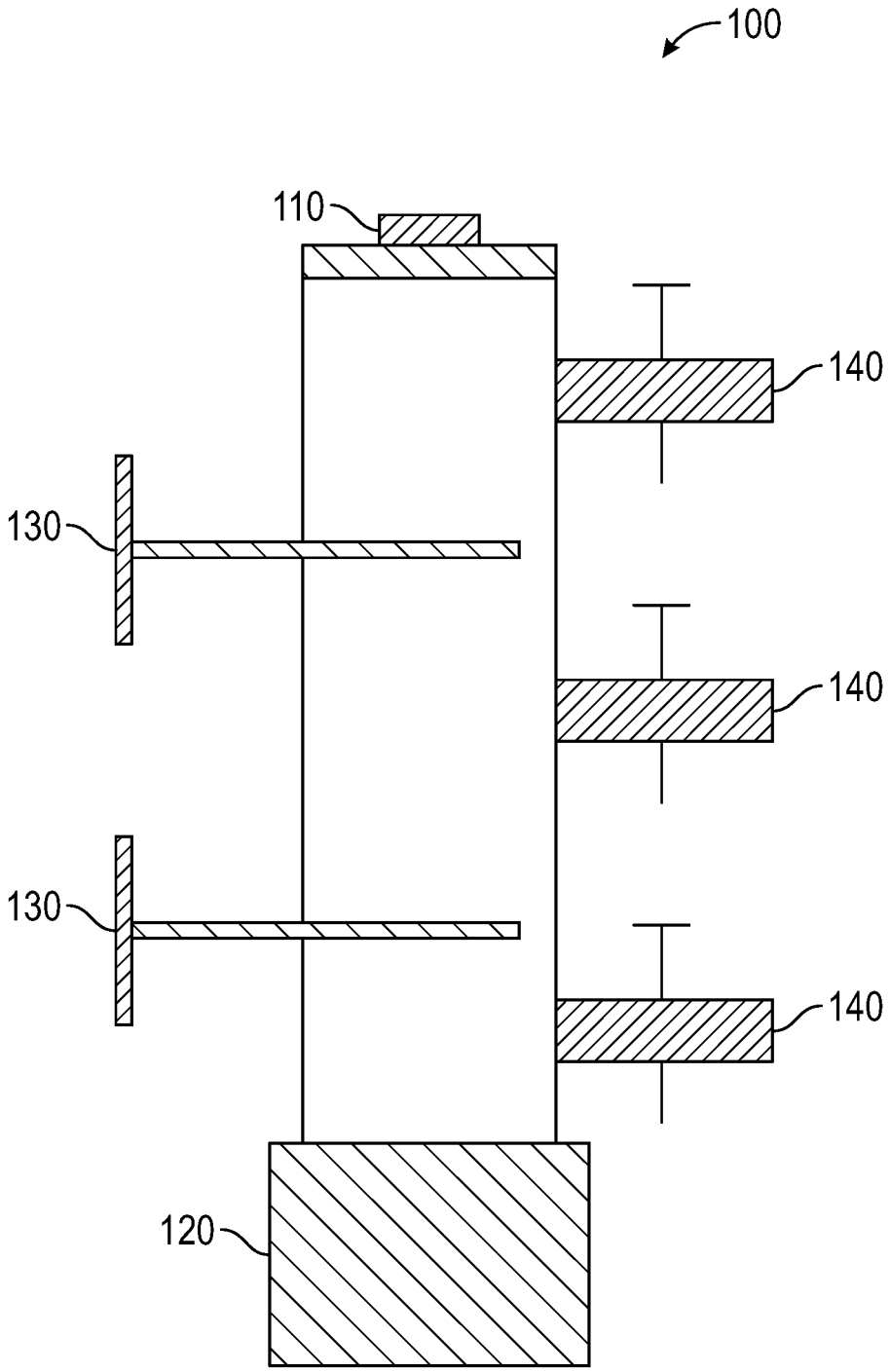
FIG. 3A illustrates a cross-sectional view of an exemplary plug container in accordance with aspects of the present disclosure.
Figure 3B:
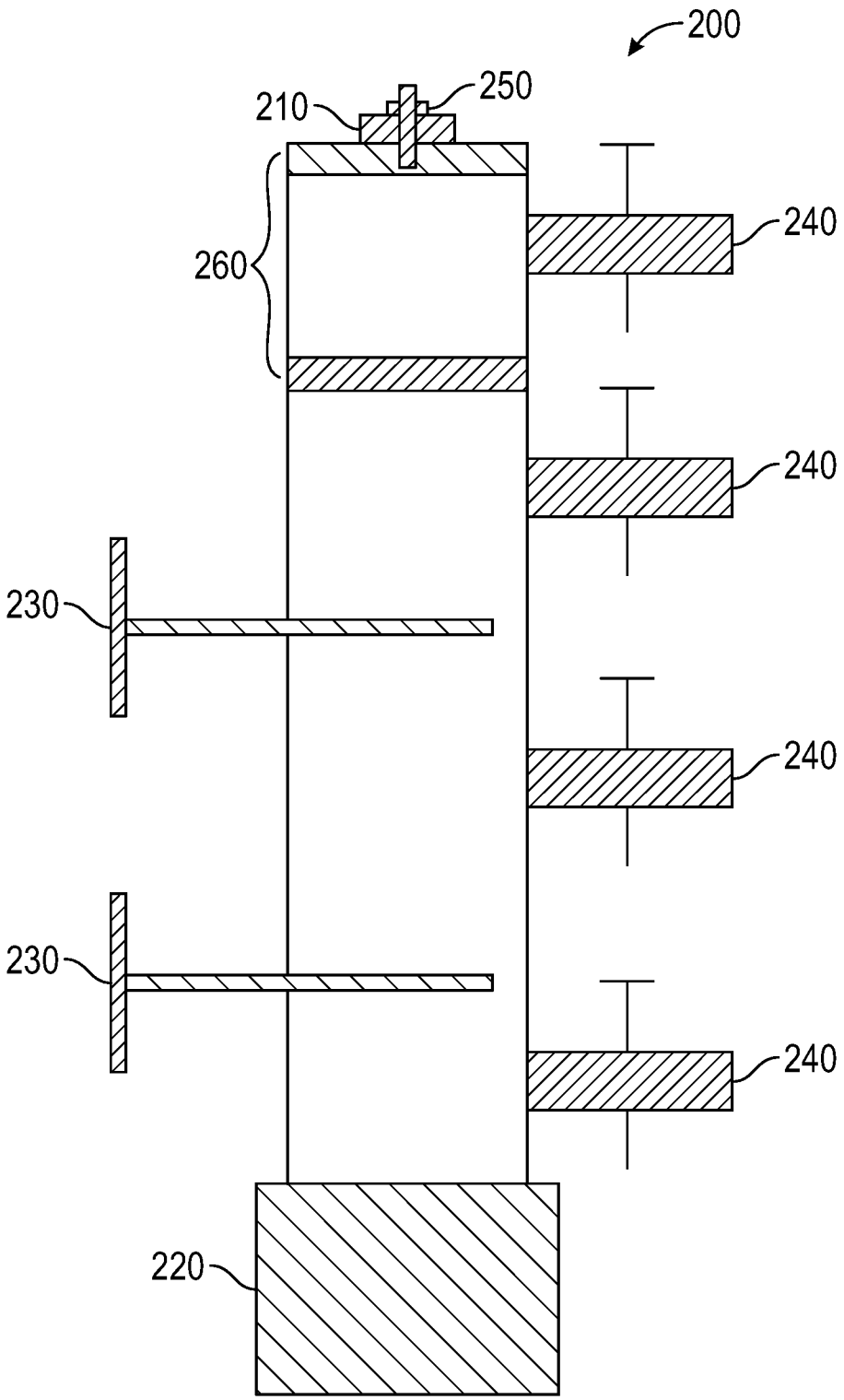
FIG. 3B illustrates a cross-sectional view of an exemplary extended plug container with extension and fiber pass through in accordance with aspects of the present disclosure.
Figure 4A:
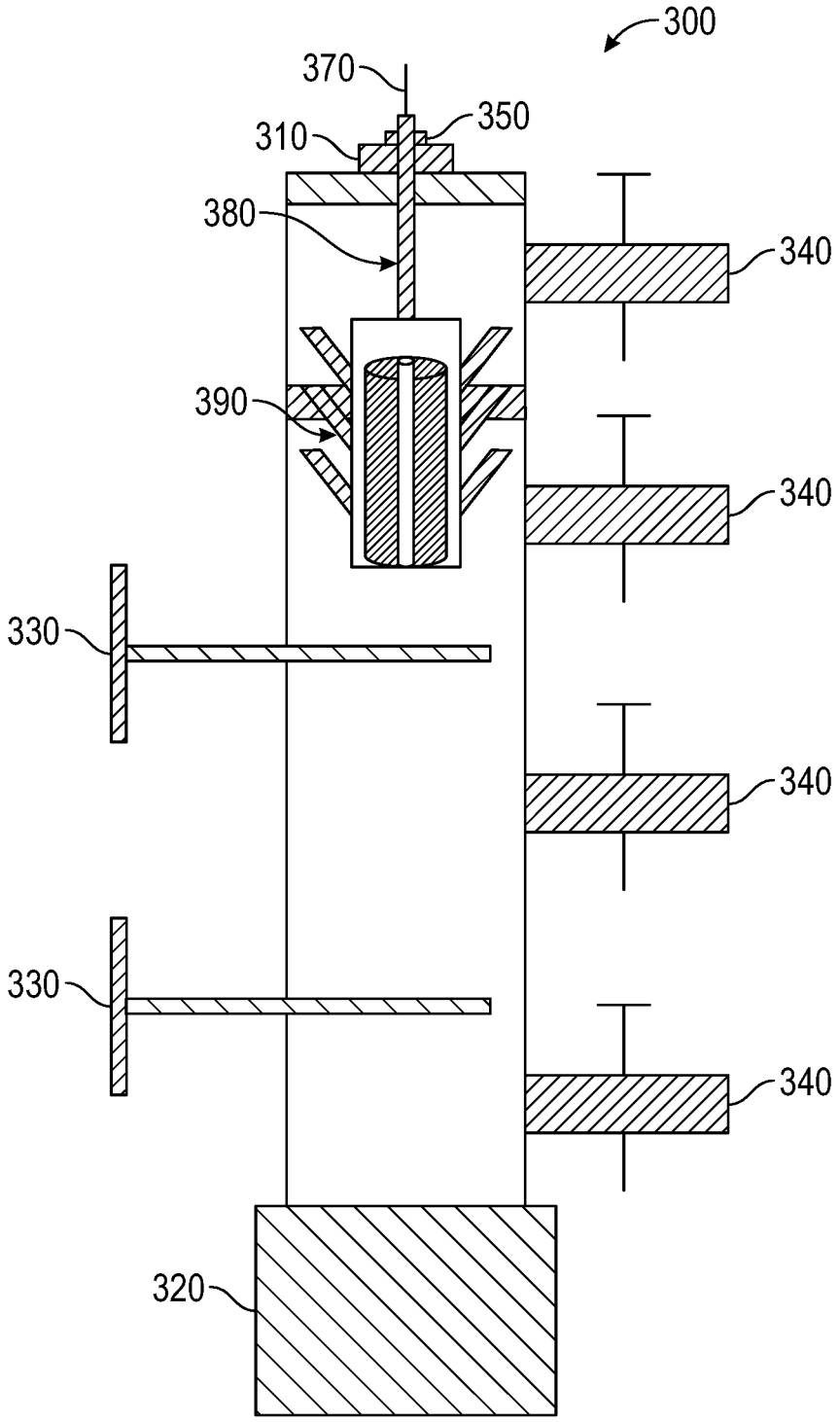
FIG. 4A illustrates a cross-sectional view of an exemplary extended plug container having a top plug in a first position in accordance with aspects of the present disclosure.
Figure 4B:
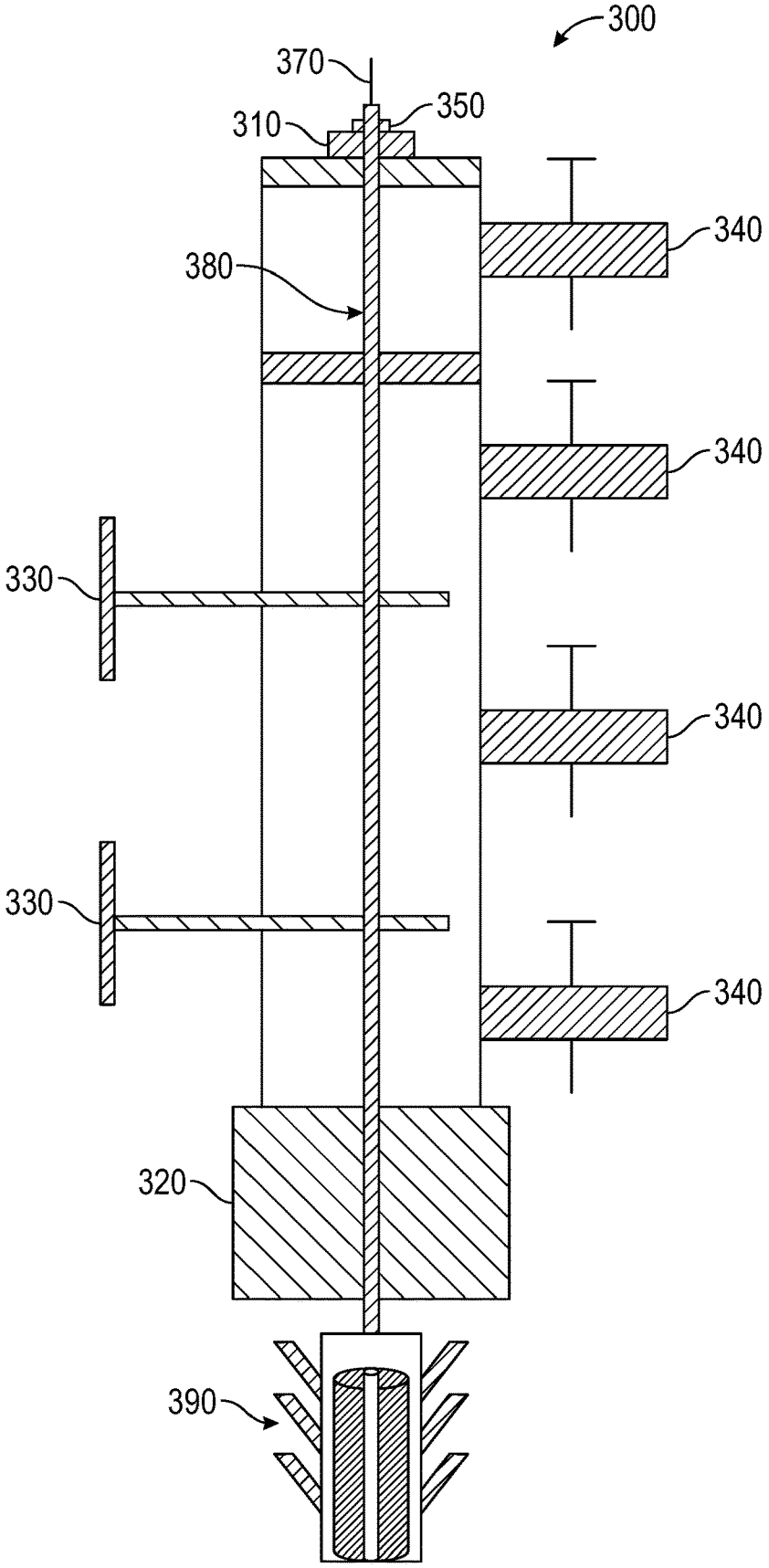
FIG. 4B illustrates a cross-sectional view of the exemplary plug container of FIG. 4A having the top plug in a second position in accordance with aspects of the present disclosure.

FIGS. 3A and 3B illustrate cross-sectional views of exemplary plug containers that can be used with the cementing systems illustrated in FIGS. 2A and 2B. Plug containers can hold top and bottom cementing plugs and commonly come in either continuous cementing heads or quick-change containers. FIG. 3A illustrates a plug container 100 having a cap 110 and a casing thread 120. In at least one instance, a plug container 100 allows a top plug (as shown in FIGS. 4A and 4B) to be loaded on top of one or more pins 130 located along the length of the plug container 300. FIG. 3B illustrates a plug container 200 having a cap 210 and a casing thread 220. In at least one instance, a plug container 200 allows a top plug (as shown in FIGS. 4A and 4B) to be loaded on top of one or more pins 230 located along the length of the plug container 200. Each of the pins can be removed sequentially to release the plugs into the wellbore. The plug container 100 can further include one or more valves 140 that can be used to attach cementing lines to the plug container 300 for circulation of fluids and displacement of the plugs. In at least one instance, the cement fluid as described above can fall down the casing in a vacuum before the plug (not illustrated) is released.

In at least one instance, a top plug capable of deploying a fiber into the wellbore can be used in accordance with the present systems and methods. In such instances, the top plug can have differing lengths to account for the length of fiber stored therein. FIG. 3B illustrates an exemplary extended plug container 200 capable of receiving a longer top plug. Specifically, the cap 210 of the extended plug container 200 can allow for an extension 260 to accept the longer plug. In addition to the length, an additional modification to the manifold can be used to ensure the capability of positive displacement of the top plug. For example, the top of the cap 210 can include a bull pug 250 that can have a threaded connection. In at least one instance, the bull plug can be removed and replaced with a threaded connection which allows a fiber to pass through and contains a connector to enable data transmission to a data acquisition system, as described in greater detail with respect to FIGS. 4A and 4B. For example, a fiber can be deployed into a wellbore via a top plug by unspooling a fiber stored within the body of the top plug. The other end of the fiber can be affixed to the plug container, whereby the fiber is fed through a modified plug container cap capable of isolating the pressure experienced on the downhole portion of the fiber. A seal (not shown) between the interior of the plug container 300 and the cap 210 can be provided to ensure the pressure within the plug container 300 is maintained. In at least one instance, the seal can include a pack-off, such as a hydraulic pack-off used in typical wireline operations. In the alternative, the fiber can be connected to a device that allows the data to be sent through the cap 210 in the plug container 300 to a control or processing system, such as data acquisition system, located on the surface. In at least some instances, the fiber can be used for the purpose of tracking the location of the plug and evaluating the effectiveness of the cementing process. However, as the fiber is deployed it can be subjected to forces from fluids within the wellbore in the axial direction. Specifically, a plurality of valves 240 permit fluid from the pumping unit to enter the plug container 300 at a 90 degree angle (in the axial direction) with respect to the fiber. Bare fibers are extremely brittle, as such the fluid forces within the wellbore can damage or break a bare fiber. As such, the pack-off or connection device must anchor the fiber sheath (described with respect to FIGS. 4A and 4B) such that the fiber is protected for at least a length to prevent damage due to the axial fluid forces.

The ability to be able to affix a fiber to a plug container for the purpose of tracking a cement plug as it is displaced into an oil and gas well would provide a competitive advantage. Specifically, real-time active tracking a plug as it is placed into an oil and gas well can allow a determination of the nature of the success of the cementing operation based at least in part on the information captured by the deployed fiber. As stated above, the ability to capture information can be dependent upon the survivability of the fiber during displacement. Methods and systems disclosed herein further provide for a sheath configured to protect a bare fiber cable from fluid displacement and flow that would otherwise damage the fiber.

FIG. 4A illustrates a cross-sectional view of an exemplary extended plug container 300 having a cap 310 and a casing thread 320 modified to allow a fiber 370 to be coupled with a top plug 390 disposed within the plug container 300; the modified cap can allow data transmission through the plug container. The top of the cap 310 can include a bull pug 350 that can have a threaded connection. In at least one instance, the bull plug can be removed and replaced with a threaded connection which allows a fiber to pass through and contains a connector to enable data transmission to a data acquisition system. As described above, the fiber can be spooled and placed into the body of the top plug. As shown, a sheath 380 can be placed over the length of fiber 370 located within the plug container and extending around the spool 300. In at least one instance, the fiber 370 can be subjected to turbulent flow for a few feet past the base of the plug container. As such, the sheath 380 can be designed to cover the portion of the fiber 370 which can be subjected to such turbulent flow. In at least one example, the sheath 380 can be from about 1 meters to about 100 meters. The length of the sheath can be adjusted based on the length of the plug container 300 and the rate of fluid flow. For example, the fluid velocity will slow after entering the plug container 300 and become a laminar or transitional flow within the wellbore. Once the fluid reaches a laminar flow within the wellbore, turbulence will not be experienced. In at least one instance, the length sheath can be from about 1 to about 10 meters. In an alternative, the length of the sheath can be less than 10 meters. The sheath 380 can be made of any suitable material including, but not limited to, plastics, polymers, metal alloys, and combinations thereof. In at least one instance, the fiber sheath 380 can be made of any material that is sufficiently pliable to be wound within a spool and sufficiently strong to protect the fiber 370 from temperature, pressure, and fluid flow for the period of time during displacement of the top plug. For example, the sheath 380 can protect the fiber 370 from forces created by spacer fluids, flushes and the cement fluid as well as the fluids used to displace the cement as it is pumped into the wellbore. The sheath 380 can be affixed to the plug container 300 such that the stress imparted from fluid movement can pass the fiber 370 without detrimental effect. Additionally, the sheath 380 can be coupled with the cap 310 of the top plug 390 such that stress from the fluid movement can be absorbed by the sheath 380 rather than imparted directly on the fiber 370. In at least one instance, a plug container 300 allows a top plug to be loaded on top of one or more pins 330 located along the length of the plug container 300. Each of the pins can be removed sequentially to release the plugs into the wellbore. The plug container 300 can further include one or more valves 340 that can be used to attach cementing lines to the plug container 300 for circulation of fluids and displacement of the plugs.

In at least one instance, the fiber can be a fiber optic cable which can house one or several optical fibers. The optical fibers may be single mode fibers, multi-mode fibers, or a combination thereof. Fiber optic sensing systems connected to the optical fibers may include Distributed Temperature Sensing (DTS) systems, Distributed Acoustic Sensing (DAS) systems, Distributed Strain Sensing (DSS) systems, quasi-distributed sensing systems where multiple single point sensors are distributed along an optical fiber/cable, or single point sensing systems where the sensors are located at the end of the cable.

The fiber optic sensing systems may operate using various sensing principles including, but not limited to, amplitude based sensing systems like, e.g., DTS systems based on Raman scattering, phase sensing based systems like, e.g., DAS systems based on interferometric sensing using e.g., homodyne or heterodyne techniques where the system may sense phase or intensity changes due to constructive or destructive inferences, strain sensing systems like DSS using dynamic strain measurements based on interferometric sensors or static strain sensing measurements using e.g., Brillouin scattering, quasi-distributed sensors based on e.g., Fiber Bragg Gratings (FBGs) where a wavelength shift is detected or multiple FBGs are used from Fabry-Perot type interferometric sensors for phase or intensity based sensing, or single point fiber optic sensors based on Fabry-Perot or FBG or intensity based sensors.

In at least one instance, electrical sensors may also be present. Such electrical sensors may be pressure sensors based on quarts type sensors, strain gauge based sensors, or other commonly used sensing technologies. Pressure sensors, optical or electrical, may be housed in dedicated gauge mandrels or attached outside the casing in various configuration for downhole deployment or deployed conventionally at the surface wellhead or flow lines.

Various hybrid approaches were single point, quasi-distributed, or distributed fiber optic sensors are mixed with e.g., electrical sensors, are also anticipated. The fiber optic cable may then include optical fiber and electrical conductors.

Temperature measurements from e.g., a DTS system may be used to determine locations for fluid inflow in the treatment well as the fluids from the surface are likely to be cooler than formation temperatures. It is known in the industry to use DTS warm-back analyses to determine fluid volume placement, this is often done for water injection wells and the same technique can be used for fracturing fluid placement. Temperature measurements in observation wells can be used to determine fluid communication between the treatment well and observation well, or to determine fluid formation movement.

DAS data can be used to determine fluid allocation in real-time as acoustic noise is generated when fluid flows through the casing and in through perforations into the formation. Phase and intensity based interferometric sensing systems are sensitive to temperature and mechanical as well as acoustically induced vibrations. DAS data can be converted from time series date to frequency domain data using Fast Fourier Transformations (FFT) and other transforms like wavelet transforms may also be used to generate different representations of the data. Various frequency ranges can be used for different purposes and where e.g., low frequency signal changes may be attributed to formation strain changes or fluid movement and other frequency ranges may be indicative of fluid or gas movement. Various filtering techniques may be applied to generate indicators of events than may be of interest. Indicators may include formation movement due to growing natural fractures, formation stress changes during the fracturing operations and this effect may also be called stress shadowing, fluid seepage during the fracturing operation as formation movement may force fluid into and observation well and this may be detected, fluid flow from fractures, fluid and proppant flow from fracturing hits. Each indicator may have a characteristic signature in terms of frequency content and/or amplitude and/or time dependent behavior, and these indicators may be. These indicators may also be present at other data types and not limited to DAS data.

DAS systems can also be used to detect various seismic events where stress fields and/or growing fracture networks generate micro-seismic events or where perforation change events may be used to determine travel time between horizontal wells and this information can be used from stage to stage to determine changes in travel time as the formation is fractured and filled with fluid and proppant. The DAS systems may also be used with surface seismic sources to generate vertical seismic profiles before, during and after a fracturing job to determine the effectiveness of the fracturing job as well as determine production effectiveness.

DSS data can be generated using various approaches and static strain data can be used to determine absolute strain changes over time. Static strain data is often measured using Brillouin based systems or quasi-distributed strain data from FBG based systems. Static strain may also be used to determine propped fracture volume by looking at deviations in strain data from a measured strain baseline before fracturing a stage. It may also be possible to determine formation properties like permeability, poro-elastic responses and leak off rates based on the change of strain vs time and the rate at which the strain changes over time. Dynamic strain data can be used in real-time to detect fracture growth through an appropriate inversion model, and appropriate actions like dynamic changes to fluid flow rates in the treatment well, addition of diverters or chemicals into the fracturing fluid or changes to proppant concentrations or types can then be used to mitigate detrimental effects.

Fiber Bragg Grating based systems may also be used for a number of different measurements. FBG's are partial reflectors that can be used as temperature and strain sensors, or can be used to make various interferometric sensors with very high sensitivity. FBG's can be used to make point sensors or quasi-distributed sensors where these FBG-based sensors can be used independently or with other types of fiber optic based sensors. FBG's can be manufactured into an optical fiber at a specific wavelength, and other systems like DAS, DSS, or DTS systems and may operate at different wavelengths in the same fiber and measure different parameters simultaneously as the FBG based systems using Wavelength Division Multiplexing (WDM).

The fiber can be placed in the well to measure well characteristics and provide communication. As described above, the fiber can track a top plug as it moves throughout a wellbore and capture temperature and pressure information corresponding thereto. Data obtained by the fiber optic sensor can be transmitted to a control or processing facility (not shown) at the surface of the wellbore. The control or processing facility may include a computing device capable of carrying out the methods and techniques of the present disclosure, including collecting and analyzing data gathered by the fiber. In some instances, the computing device can be equipped to process the received information in substantially real-time. In other instances, the computing device can be equipped to store the received information for processing at some subsequent time. The computing system is described in greater detail with respect to FIG. 5.

In at least one instance, the sheath 380 for protecting the fiber 370 can be contained within, and dispensed out of, the top plug 390 during displacement of the top plug 390 from the plug container 300. For example, the sheath 380 can be placed over the fiber 370 and then wound around a bobbin or reel placed within the top plug 390 such that the fiber 370 and sheath 380 can be unwound as the top plug 390 is deployed.

FIG. 4B illustrates the plug container 300 of FIG. 4A in a second position, showing the plug deployed through the plug container. The fiber 370 can be used to track the progress of the top plug 390 in real-time as well as capture temperature and pressure information throughout the wellbore. The quality of data obtained by the fiber 370 is highly dependent on the viability of the fiber cable that is deployed. The fiber sheath 380 disclosed herein can increase the viability of the data obtained by the fiber 370 by reducing the stress imparted on the fiber 370 as it moves throughout the wellbore. The systems and methods described herein can provide a competitive advantage to actively track the progress of the top plug 390 throughout the wellbore in real-time. In some instances, the systems and methods can be used to determine the nature of the success of the cementing operation based in part on the information captured by the fiber 370.

In at least one instance, the sheath 380 for protecting the fiber 370 can be disposable and designed for single use. In the alternative, the sheath 380 can be reusable and designed for repeated uses.

In at least one instance, the fiber 370 pass through of the cap 310 can be include a bladder or pack-off to allow the fiber to transmit data through a pressurized condition within the plug container 300 to an atmospheric condition outside the plug container 300. As described above, the pack-off can be similar to those used in typical wireline operations. For example, the pass through can include a hydraulic element which squeezes around the circumference of the fiber 370. In at least one instance, the hydraulic element can be pumped up with a hydraulic press. Once the cementing job and evaluation is completed, the hydraulic element can be relieved and the fiber 370 and sheath 380 can be removed from the plug container 300 and reloaded for another job. In the alternative, a connector can be present on the inside of the cap 310 (high pressure side) that has a high-pressure connection to where a cable can be attached on the outside of the cap 310 (low pressure side) in order to transfer the information.

In at least one instance, a method for using the above described system can include deploying a fiber within a protective sheath. The protective sheath having the fiber therein can then be spooled and placed inside a modified top plug, which allows the fiber and sheath to be unwound as the top plug moves throughout the wellbore.

Figure 5:
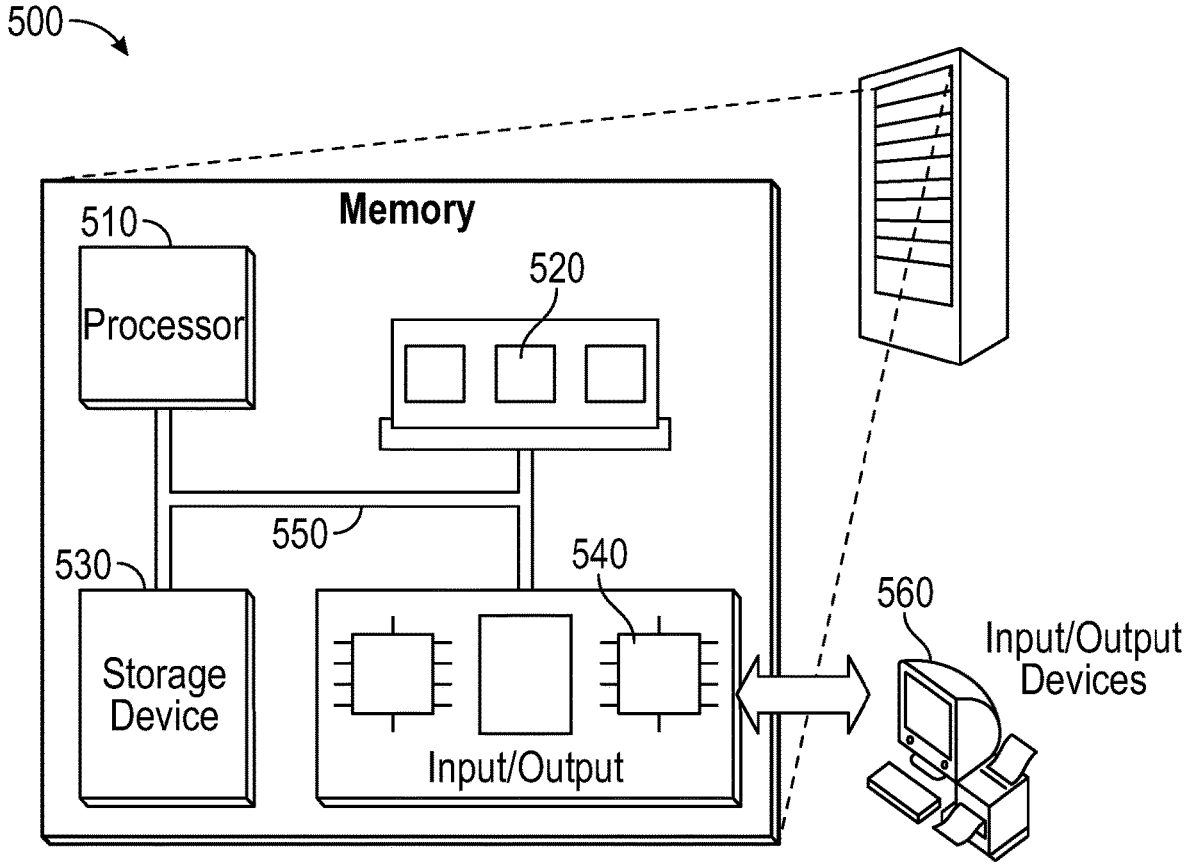
FIG. 5 illustrates an exemplary processing system for configuring and/or controlling the a fiber disposed within a wellbore.

FIG. 5 shows an illustrative processing system 500 for configuring and/or controlling the fiber optic sensor for performing measurements as described herein. The system 500 may include a processor 510, a memory 520, a storage device 530, and an input/output device 540. Each of the components 510, 520, 530, 540 may be interconnected, for example, using a system bus 550. The processor 510 may be processing instructions for execution within the system 500. In some instances, the processor 510 is a single-threaded processor, a multi-threaded processor, or another type of processor. The processor 510 may be capable of processing instructions stored in the memory 520 or on the storage device 530. The memory 520 and the storage device 530 can store information within the computer system 500.

The input/output device 540 may provide input/output operations for the system 500. In some instances, the input/output device 540 can include one or more network interface devices. In some instances, the input/output device can include driver devices configured to receive input data and send output data to other input/output devices including, but not limited to, keyboards, printers, and display devices 560. In some instances, mobile computing devices, mobile communication devices, and other devices can be used.

Numerous examples are provided herein to enhance understanding of the present disclosure. A specific set of statements are provided as follows.

Statement 1: A plug container comprising an elongated body having a first end, a second end, and a flow path therethrough; a cap coupled with the first end of the elongated body, the cap further comprising a pass-through for receiving a communication line; a threaded connector at the second end of the elongated body for coupling a casing; and a top plug sized to fit within the flow path of the elongated body and couplable with the communication line.

Statement 2: A plug container in accordance with Statement 1, wherein the top plug further comprises a cavity for storing a length of the communication line therein.

Statement 3: A plug container in accordance with Statement 1 or Statement 2, further comprising a reel stored within the cavity of the top plug and receiving the length of communication line.

Statement 4: A plug container in accordance with Statements 1-3, further comprising a protective sheath coupled with the top plug and the pass-through of the cap, the protective sheath enclosing the communication line therein.

Statement 5: A plug container in accordance with Statements 1-4, wherein the protective sheath is one or more of a plastic, a polymer, and a metal alloy.

Statement 6: A plug container in accordance with Statements 1-5, wherein the elongated body is sized to fit the top plug having the cavity therein.

Statement 7: A plug container in accordance with Statements 1-6, wherein the pass-through of the cap further comprises a bladder for maintaining a pressure within the elongated body.

Statement 8: A plug container in accordance with Statements 1-6, wherein the pass-through of the cap further comprises a pack-off for maintaining a pressure within the elongated body.

Statement 9: A plug container in accordance with Statements 1-8, wherein the communication line is a fiber optic cable to obtain and transmit data to a surface control facility.

Statement 10: A plug container in accordance with Statements 1-9, wherein the data includes one or more of a temperature, a pressure, and a top plug location.

Statement 11: A plug container in accordance with Statements 1-10, further comprising one or more pins removably communicable with the flow path of the elongated body, the one or more pins directing the movement of the top plug through the flow path.

Statement 12: A plug container in accordance with Statements 1-11, further comprising one or more valves coupled with the elongated body for providing a fluid flow into the flow path of the elongated body.

Statement 13: A system for evaluating a wellbore having a casing disposed therein, the system comprising a communication line for obtaining data within the wellbore, the communication line having a protective sheath surrounding a length thereof; a plug container coupled with and to facilitate repositioning of the communication line, the plug container comprising an elongated body having a first end, a second end, and a flow path therethrough, a cap coupled with the first end of the elongated body, the cap further comprising a pass-through for receiving the communication line, and a threaded connector at the second end of the elongated body for coupling the casing within the wellbore; a top plug sized to fit within the flow path of the plug container and couplable with the communication line and protective sheath; and a control facility communicatively coupled with the communication line, the control facility including one or more processors coupled with at least one non-transitory computer-readable storage medium storing instructions which, when executed by the one or more processors, cause the processors to releasing the top plug from the plug container and into the casing of the wellbore, receive, via the communication line, data relating to wellbore conditions, and evaluating the wellbore conditions.

Statement 14: A system in accordance with Statement 13, further comprising a cementing tool positionable at the surface of the wellbore for pumping a cement composition through the casing.

Statement 15: A system in accordance with Statement 13 or Statement 14, wherein the plug container further comprises one or more valves coupled with the elongated body for providing a fluid flow from the cementing tool into the flow path of the elongated body; and one or more pins removably communicable with the flow path of the elongated body, the one or more pins directing the movement of the top plug through the flow path of the plug container during a cementing process.

Statement 16: A system in accordance with Statements 13-15, wherein the evaluation of the wellbore conditions includes determining the effectiveness of the cementing process.

Statement 17: A system in accordance with Statements 13-16, wherein the wellbore conditions include one or more of a temperature, a pressure, and a top plug location.

Statement 18: A system in accordance with Statements 13-17, wherein the top plug further comprises a cavity for storing a length of the communication line therein; and a reel stored within the cavity for receiving and dispensing the length of communication line surrounded by the protective sheath.

Statement 19: A system in accordance with Statements 13-18, wherein the protective sheath is one or more of a plastic, a polymer, and a metal alloy.

Statement 20: A system in accordance with Statements 13-19, wherein the pass-through of the cap further comprises a bladder for maintaining a pressure within the elongated body of the plug container.

Statement 21: A system in accordance with Statements 13-19, wherein the pass-through of the cap further comprises a pack-off for maintaining a pressure within the elongated body of the plug container.

Statement 22: A system in accordance with Statements 13-21, wherein the communication line is a fiber optic cable to obtain and transmit data to a surface control facility.

Statement 23: A method for evaluating a wellbore, the method comprising inserting a length of a communication line into a protective sheath; coupling a first end of the protective sheath with a top plug and a second end of the protective sheath with a cap of a plug container, the plug container comprising an elongated body having a first end, a second end, and a flow path therethrough, the flow path sized to fit the top plug therein, the cap coupled with the first end of the elongated body and further comprising a pass-through for receiving the remaining communication line, and a threaded coupling at the second end of the elongated body; deploying the top plug within the plug container via the fiber into a wellbore casing coupled with the threaded coupling of the plug container during a cementing process; and obtaining data, via the communication line, corresponding to one or more wellbore conditions, the one or more wellbore conditions including at least a temperature, a pressure, and a top plug location.

Statement 24: A method in accordance with Statement 23, further comprising transmitting the data corresponding to one or more wellbore conditions to a control facility communicatively coupled with the communication line, and evaluating, via one or more processors of the control facility, the wellbore conditions to determine an effectiveness of the cementing process.

Statement 25: A method in accordance with Statement 23 or Statement 24, wherein the top plug further comprises a cavity for storing a length of the communication line therein.

Statement 26: A method in accordance with Statements 23-25, further comprising a reel stored within the cavity of the top plug and receiving the length of communication line.

Statement 27: A method in accordance with Statements 23-26, wherein the protective sheath is one or more of a plastic, a polymer, and a metal alloy.

Statement 28: A method in accordance with Statements 23-27, wherein the elongated body is sized to fit the top plug having the cavity therein.

Statement 29: A method in accordance with Statements 23-28, wherein the pass-through of the cap further comprises a bladder for maintaining a pressure within the elongated body.

Statement 30: A method in accordance with Statements 23-28, wherein the pass-through of the cap further comprises a pack-off for maintaining a pressure within the elongated body.

Statement 31: A method in accordance with Statements 23-30, further comprising positioning a cementing tool at the surface of the wellbore for pumping a cement composition through the casing.

Statement 32: A method in accordance with Statements 23-31, wherein the communication line is a fiber optic cable to obtain and transmit data to a surface control facility.

Statement 33: A method in accordance with Statements 23-32, further comprising providing a fluid flow from the cementing tool into the flow path of the elongated body via one or more valves coupled with the elongated body of the plug container; and directing the movement of the top plug through the flow path of the plug container via one or more pins removably communicable with the flow path of the elongated body.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A plug container comprising:

an elongated body having a first end, a second end, and a flow path therethrough;

one or more pins removably communicable with the flow path of the elongated body;

a cap coupled with the first end of the elongated body, the cap further comprising a pass-through for receiving a communication line;

wherein the pass-through of the cap further comprises a bladder for maintaining a pressure within the elongated body;

a threaded connector at the second end of the elongated body for coupling a casing; and a top plug sized to fit within the flow path of the elongated body;

wherein the top plug further comprises a cavity for storing a length of the communication line therein;

the one or more pins directing the movement of the top plug through the flow path;

the communication line stored within the elongated body with one end of the communication line affixed to the plug container;

whereby the communication line is fed through the cap to isolate the pressure experienced on the downhole portion of the communication line; and the bladder located between the interior of the plug container and the cap to ensure the pressure within the plug container is maintained.

2. The plug container of claim 1, further comprising a reel stored within the cavity of the top plug and receiving the length of communication line.

3. The plug container of claim 2, further comprising a protective sheath coupled with the top plug and the pass-through of the cap, the protective sheath enclosing the communication line therein.

4. The plug container of claim 3, wherein the protective sheath is one or more of a plastic, a polymer, and a metal alloy.

5. The plug container of claim 1, wherein the elongated body is sized to fit the top plug having the cavity therein.

6. The plug container of claim 1, wherein the communication line is a fiber optic cable to obtain and transmit data to a surface control facility.

7. The plug container of claim 1, further comprising one or more valves coupled with the elongated body for providing a fluid flow into the flow path of the elongated body.

8. A system for evaluating a wellbore having a casing disposed therein, the system comprising:

a communication line for obtaining data within the wellbore, the communication line having a protective sheath surrounding a length thereof;

a plug container coupled with and to facilitate repositioning of the communication line, the plug container comprising:

an elongated body having a first end, a second end, and a flow path therethrough, one or more pins removably communicable with the flow path of the elongated body;

a cap coupled with the first end of the elongated body, the cap further comprising a pass-through for receiving the communication line, and wherein the pass-through of the cap further comprises a bladder for maintaining a pressure within the elongated body;

a threaded connector at the second end of the elongated body for coupling the casing within the wellbore;

a top plug sized to fit within the flow path of the plug container and couplable with the communication line and protective sheath;

wherein the top plug further comprises a cavity for storing a length of the communication line therein and a reel stored within the cavity for receiving and dispensing the length of communication line surrounded by the protective sheath;

the one or more pins directing the movement of the top plug through the flow path;

the communication line stored within the elongated body with one end of the communication line affixed to the plug container;

whereby the communication line is fed through the cap to isolate the pressure experienced on the downhole portion of the communication line;

the bladder located between the interior of the plug container and the cap to ensure the pressure within the plug container is maintained; and a control facility communicatively coupled with the communication line, the control facility including one or more processors coupled with at least one non-transitory computer-readable storage medium storing instructions which, when executed by the one or more processors, cause the one or more processors to:

releasing the top plug from the plug container and into the casing of the wellbore, receive, via the communication line, data relating to wellbore conditions, and evaluating the wellbore conditions.

9. The system of claim 8, further comprising a cementing tool positionable at the surface of the wellbore for pumping a cement composition through the casing.

10. The system of claim 9, wherein the plug container further comprises:

one or more valves coupled with the elongated body for providing a fluid flow from the cementing tool into the flow path of the elongated body.

11. The system of claim 10, wherein the evaluation of the wellbore conditions includes determining the effectiveness of the cementing process.

12. The system of claim 8, wherein the wellbore conditions include one or more of a temperature, a pressure, and a top plug location.

13. The system of claim 8, wherein the protective sheath is one or more of a plastic, a polymer, and a metal alloy.

14. A method for evaluating a wellbore, the method comprising:

inserting a length of a communication line into a protective sheath;

coupling a first end of the protective sheath with a top plug and a second end of the protective sheath with a cap of a plug container, the plug container comprising:

an elongated body having a first end, a second end, and a flow path therethrough, one or more pins removably communicable with the flow path of the elongated body;

the one or more pins directing the movement of the top plug through the flow path;

the flow path sized to fit the top plug therein, the cap coupled with the first end of the elongated body and further comprising a pass-through for receiving the remaining communication line, and wherein the pass-through of the cap further comprises a bladder for maintaining a pressure within the elongated body;

a threaded coupling at the second end of the elongated body;

the communication line stored within the elongated body with one end of the communication line affixed to the plug container;

whereby the communication line is fed through the cap to isolate the pressure experienced on the downhole portion of the communication line;

the bladder located between the interior of the plug container and the cap to ensure the pressure within the plug container is maintained;

deploying the top plug within the plug container via the communication line into a wellbore casing coupled with the threaded coupling of the plug container during a cementing process; and obtaining data, via the communication line, corresponding to one or more wellbore conditions, the one or more wellbore conditions including at least a temperature, a pressure, and a top plug location.

15. The method of claim 14, further comprising:

transmitting the data corresponding to one or more wellbore conditions to a control facility communicatively coupled with the communication line, and evaluating, via one or more processors of the control facility, the wellbore conditions to determine an effectiveness of the cementing process.

* * * * *